US006630032B2

(12) United States Patent
Carmi et al.

(10) Patent No.: US 6,630,032 B2
(45) Date of Patent: Oct. 7, 2003

(54) METHOD AND APPARATUS FOR DISLODGING ACCRUED DEPOSITS FROM A VESSEL

(75) Inventors: Gennady Carmi, Beer Sheva (IL); Yuri Ass, Beer Sheva (IL)

(73) Assignee: ProWell Technologies, Ltd., Arava (IL)

( * ) Notice: Subject to any disclaimer, the term of this patent is extended or adjusted under 35 U.S.C. 154(b) by 23 days.

(21) Appl. No.: 09/878,875

(22) Filed: Jun. 11, 2001

(65) Prior Publication Data

US 2002/0029792 A1 Mar. 14, 2002

Related U.S. Application Data

(63) Continuation-in-part of application No. 09/259,363, filed on Feb. 26, 1999, now Pat. No. 6,250,388.

(51) Int. Cl.[7] ..... B08B 7/02

(52) U.S. Cl. ..... 134/1; 134/16; 134/17; 134/22.1; 134/22.18; 134/24; 15/104.03; 15/104.05; 15/240.5; 15/304; 15/312.1; 15/316.1; 15/318; 15/404; 15/405; 15/406; 15/408

(58) Field of Search ..... 134/1, 16, 17, 134/22.1, 22.12, 22.18, 24; 15/104.03, 104.05, 246.5, 304, 312.1, 316.1, 318, 404, 405, 406, 408

(56) References Cited

U.S. PATENT DOCUMENTS

| | | | | |
|---|---|---|---|---|
| 4,571,138 A | | 2/1986 | Farajun | |
| 4,645,542 A | * | 2/1987 | Scharton et al. | 134/1 |
| 4,881,856 A | | 11/1989 | Greig | |
| 4,942,982 A | | 7/1990 | Hartwigsen | |
| 5,316,591 A | | 5/1994 | Chao | |
| 5,423,917 A | * | 6/1995 | Garcia, Jr. | 134/1 |
| 5,584,939 A | * | 12/1996 | Dahlin et al. | 134/7 |
| 5,649,338 A | | 7/1997 | Kato | |

* cited by examiner

*Primary Examiner*—Randy Gulakowski
*Assistant Examiner*—M. Kornakov
(74) *Attorney, Agent, or Firm*—Lilling & Lilling P.C.

(57) ABSTRACT

Apparatus for dislodging an accretion of a substance from the vicinity of a vessel, includes apparatus for generating gas-borne shock waves in the vicinity of a vessel, thereby to expose a substance accrued on a surface thereof to separation forces causing at least partial separation of the substance from the surface, so as to facilitate removal of the at least partially separated substance therefrom; and support apparatus for supporting the apparatus for generating shock waves in a selected association relative to the vessel.

10 Claims, 7 Drawing Sheets

METHOD AND APPARATUS FOR DISLODGING ACCRUED DEPOSITS FROM A VESSEL

REFERENCE TO CO-PENDING APPLICATIONS

The present application is a continuation-in-part of U.S. Ser. No. 09/259,363, filed on Feb. 26, 1999 now U.S. Pat. No. 6,250,388 for "GAS IMPULSE DEVICE AND METHOD OF USE THEREOF", the contents of which are incorporated herein, by reference.

FIELD OF THE INVENTION

The present invention relates, generally, to a method and apparatus for dislodging deposits from a vessel and, more specifically, to as method for dislodging deposits from a vessel using a gas impulse device.

BACKGROUND OF THE INVENTION

In the handling and storage of particulate solids, problems are encountered in various items of equipment. Most common of these items of equipment is the silo, generally a large, vertical, cylindrical vessel with a conical base fitted with an outlet valve mechanism. The term silo is, however, often used interchangeably with any of the terms bin, tank and bunker. Shapes vary, including those having square or rectangular cross-section and those with flat, pyramidal or dished bases.

A common problem occurring in silos as well as in other solid handling equipment is the accretion of particulate solids which eventually gives rise to reduced flow through the vessel or, in extreme cases, to complete blockage of the vessel.

In more serious cases of agglomeration, the flow from a vessel is partially or totally restricted by bridging of solids across the vessel outlet. Another, similar, problem is referred to as "rat-holing," which also results in restricted flow from a vessel. When there occurs a severe build up of accumulated solids, specialized apparatus is generally required to remove the build-up. There are known in the art, mechanical methods for solving problems of undesired accumulation of solids. By way of example, where an undesirable accumulation of particulate matter is easily accessible, a hammer and chisel (manual or pneumatic) may be used to fracture and remove the agglomerated particles.

In the case of closed vessels with restricted manual access, such as a large silo, there are several known cleaning methods available. One method utilizes a device commonly referred to in the art as a "whip." This device is pneumatically or hydraulically driven, and consists of a cutting head supported from the roof opening of a silo. The cutting head rotates rapidly so that flail chains attached to the head repeatedly strike the layer of accumulated material while the head is progressively translated upward or downward within the silo. This process is generally slow and rather cumbersome, and often poses a risk of damage to the silo being treated.

Other devices well known in the art for preventing or removing build-up of solids in flow through systems are air cannons and vibrators. Air cannons are, however, only moderately efficient for breaking up bridging and ineffective for overcoming rat-holing. Vibrators are only minimally effective for overcoming both bridging and rat-holing.

Apart from being time consuming and wasteful of resources, the implementation of such mechanical methods is generally known to be problematic. Furthermore, such mechanical processes are often known to create risk of dust explosion or fire, particularly when carried out in dusty environments. Where food or medicinal environments are concerned, such mechanical cleaning methods also give rise to considerations of hygiene. There also exists the possibility of emission of undesirable or harmful gases.

Referring to U.S. Pat. No. 4,571,138 to Farajun, entitled "Apparatus For Silo Clean Out," there is described apparatus for cleaning solids that have accumulated in places of restricted access such as silos, hoppers and the like. This cleaning apparatus includes a power driven device for impacting the accumulated material and allowing it to fall away. The device for impacting the solids is suspended from and powered by a cable and hose combination, which is reeled onto a drum supported above the material in the silo. The drum is rotatable to reel-out or reel-in the cable and hose to position the impacting device in the vicinity of the material to be removed. The apparatus includes provision for automatically reversing the impacting device along the material face and, in the event of a material avalanche, for releasing the drum to allow the impacting device to fall downwardly with the flowing material in the silo.

Referring now to U.S. Pat. No. 4,881,856 to Greig, entitled "Chip Snake," there is described a cleaning device for loosening and removing accumulated material, such as wood chips, in silos, using a raking action of regularly spaced spikes and a flailing action of a hose with a jet stream nozzle. The device includes a hose, connected to a compressed air supply, and a nozzle at the end of the hose. Compressed air is passed through the hose and exits the nozzle causing the nozzle and hose to move under the influence of the expelled compressed air. Spikes are attached along the hose to provide regularly spaced raking elements. Anti-kink mechanisms maintain the hose in a straight alignment. The operation involves lowering the nozzle into a silo in the vicinity of agglomerated material. Then compressed air is introduced into the hose and expelled out of the nozzle in a jet stream, thereby causing the hose and nozzle to move about in the silo, so that the spikes strike and dislodge the impacted material.

Further, referring to U.S. Pat. No. 4,942,982 to Hartwigsen, et al., entitled "Silo Cleaning Apparatus," there is described apparatus for cleaning a silo which has a mass of agglomerated particles. Dislodging the accumulated mass is achieved by extending at least one flexible tube connected to a bludgeon into the silo near to the accumulated mass and introducing gas through the tube and bludgeon at a rate and pressure that causes swinging and writhing movements by the bludgeon and tube.

Referring also to U.S. Pat. No. 5,649,338 to Kato, entitled "Automatic Interior Cleaning System For A Powdered Material Processing Device," there is described an automatic interior cleaning system for processing equipment for handling finely divided material. The equipment requiring cleaning includes interior surfaces of, for example, silos, mixers, and dust collectors. A compressor and a gas storage tank supply gas, preferably air, at a sufficient pressure to dislodge residues of materials that collect on interior surfaces. A valve connecting the gas tank to a cleaning-nozzle tube opens and closes, supplying pulses of air to the cleaning nozzle tube. The cleaning nozzle tube delivers the pulses through slots in the tube to the inner surface of the equipment requiring cleaning. The pressurized air pulses produce shock waves, which dislodge any residues from the interior surface. Automatic removal of residues during processing prevents contamination of subsequently processed materials.

Other known processes for the cleaning of closed vessels utilize liquid carbon dioxide for effecting cavitation erosion of accumulated solids. Such processes are employed where mechanical methods pose a risk of flammability.

Referring to U.S. Pat. No. 5,316,591 to Chao, et al., entitled "Cleaning By Cavitation In Liquefied Gas," there is described the removal of undesired material from a chosen substrate by a process comprising placing the substrate containing the undesired material in a cleaning chamber provided with means for causing cavitation. The process involves introducing a liquefied gas, such as liquid carbon dioxide, into the cleaning chamber in contact with the substrate containing the undesired material, with the liquid carbon dioxide at a temperature below its critical temperature. Exposing the liquid carbon dioxide to the cavitation-producing means for a period of time is sufficient to remove the undesired material from the substrate. The substrate containing the undesired material may optionally be contacted with carbon dioxide in the dense phase prior to and/or after the cavitation treatment to aid in removal of the undesired material. Further, spent liquid carbon dioxide may be treated to regenerate fresh liquid carbon dioxide, which is recycled to the cleaning chamber. Other gases besides carbon dioxide, which may be used, include nitrous oxide, sulfur hexafluoride, and xenon.

In a similar manner to that described in U.S. Pat. No. 5,316,591 quoted above, carbon dioxide, at a temperature below the critical temperature, is sprayed at close range on to accrued solids and, as the liquid is absorbed into the void-space of the solid mass, the rapid expansion caused by vaporization fragments and loosens the agglomerate.

With regard to chemical cleaning processes, a plethora of information, well known in the art, is available both in the literature and in technical brochures relating to chemical cleaning and chemically activated or detergent washing processes. Many such procedures utilize a solvent or carrier medium such as organic solvents or water together with acids, alkalis, suitable wetting agents/detergents and so on. These washing or rinsing processes give rise to several problems, not the least of which is disposal of effluent as well as the drying of the treated surfaces. There is, also, the risk of chemical reaction with the agglomerated material, giving rise, under certain conditions, to heat generation, undesirable gas emission or even explosions. Additionally, these processes are known to create a risk of chemical damage to the storage or handling equipment being treated. Furthermore these processes tend to be tedious and costly, and present another, perhaps more serious, difficulty, namely, disposal of the effluent or the cost of recovery of the agglomerated material.

SUMMARY OF THE INVENTION

The present invention seeks to provide an apparatus and method for effective cleaning and maintenance of storage, transport and handling vessels, directed to overcoming disadvantages of known art. More specifically, the present invention is directed to providing an apparatus and method for loosening and removing accretions of accumulated particulate solids from the vicinity of a vessel wall, particularly in a non-liquid environment. Additionally, the present invention is directed to providing environmentally friendly solutions for separating and breaking regions of bridging or rat-holing of agglomerated particulate solids across a vessel outlet, thereby to relieve blockages associated therewith.

In seeking to achieve the above objectives, and in accordance with a preferred embodiment of the present invention, suitable apparatus, for example, as described in the Applicant's co-pending U.S. application Ser. No. 09/259,363, for generating shock-waves or gas impulses is provided and positioned in the vicinity of, or within, a gas-containing region of a vessel having an accretion of solids sought to be removed. The apparatus is operated so as to produce a series of shock waves or impulses which are propagated through the gas-containing portion of the vessel, thereby to loosen and progressively separate the agglomerated solids from surfaces of the vessel to which they are attached, or from regions of the vessel where they have accumulated.

There is thus provided, in accordance with a preferred embodiment of the invention, apparatus for dislodging an accretion of a substance from the vicinity of a vessel, the apparatus including:

apparatus for generating gas-borne shock waves in the vicinity of a vessel, thereby to expose a substance accrued on a surface thereof to separation forces causing at least partial separation of the substance from the surface, so as to facilitate removal of the at least partially separated substance therefrom; and support apparatus for supporting the apparatus for generating shock waves in a selected association relative to the vessel.

Also, in accordance with a preferred embodiment of the present invention, there is provided a method for dislodging an accretion of a substance deposited in the vicinity of a vessel, the method including the steps:

mounting a source of gas-borne shock waves in a selected orientation with respect to a substance accrued on a facing surface of a vessel; and operating the source of gas-borne shock waves so as to expose the accrued substance to separation forces, thereby causing at least partial separation of the accrued substance from the surface, so as to facilitate removal of the at least partially separated substance from the vessel.

Additionally, in accordance with a preferred embodiment of the present invention, the apparatus for generating gas-borne shock waves includes one or more gas impulse devices, which utilize compressed gas to generate gas-borne shock waves.

Further, and in accordance with one embodiment of the present invention, one or more gas impulse devices are adjustably suspended within a vessel adjacent to a substance accrued on an inward-facing surface thereof. The positions of the suspended one or more gas impulse devices are adjustable so that movement both vertically upward or downward and circumferencially within the vessel is facilitated, whereby proximity to accretion of solids is accomplished.

Furthermore, according to another variation of an embodiment of the present invention, one or more gas impulse devices are adjustably positioned adjacent to a substance accrued on an outward-facing surface.

A further variation in an embodiment of the present invention relates to apparatus in which one or more gas impulse devices are fixably attached into an orifice in a wall of a vessel and protruding into the interior thereof. Fixably mounting one or more gas impulse devices provides a facility for frequently eliminating accretion of solids as part of the operating cycle of a vessel or other solids handling equipment.

An additional variation in an embodiment of the present invention relates to apparatus in which one or more gas impulse devices include a compressed gas source fixably connected via a conduit thereto.

Another variation in an embodiment of the present invention relates to apparatus in which the compressed gas includes at least one gas selected from the group which may include, either alone or in any combination, air, nitrogen and carbon dioxide.

Frequently, for reasons of cost, convenience and availability, air is the selected compressed gas, generally supplied from an air compressor. However, in circumstances where reactivity between the oxygen in the air and the particulate solids give rise to a risk of explosion or fire, nitrogen or carbon dioxide are preferred although nitrogen is generally less expensive.

According to another embodiment to the present invention the method includes mounting a source of gas-borne shock waves in a selected orientation with respect to a substance accrued on an inward-facing surface of a vessel and includes fixably attaching the source of gas-borne shock waves within the inward-facing surface of the vessel.

According to an additional embodiment to the present invention the method includes mounting a source of gas-borne shock waves in a selected orientation with respect to a substance accrued on an inward-facing surface of a vessel and includes adjustably suspending the source of gas-borne shock waves within the vessel.

According to a further embodiment to the present invention, the method, in terms of which operating the source of gas-borne shock waves within the vessel, includes moving the source of gas-borne shock waves within the vessel thereby to expose a substance accrued on an inward-facing surface thereof to separation forces, causing at least partial separation of the substance from the inward-facing surface, so as to facilitate removal of the at least partially separated substance therefrom.

According to another embodiment to the present invention the method includes moving the source of gas-borne shock waves in the vicinity of an external surface of the vessel, thereby to expose a substance accrued on the external surface to separation forces causing at least partial separation of the substance from the external surface, so as to facilitate removal of the at least partially separated substance therefrom.

Additionally, according to an embodiment to the present invention the method includes operating the source of gas-borne shock waves by supplying a compressed gas to the source of gas-borne shock waves.

It will be appreciated by persons skilled in the art, that the apparatus and method of the present invention represents many advantages to a user in comparison to known art. For example, the present invention allows for cleaning of large or small vessels including silos, tanks, feed-hoppers, chimney-stacks, pipes, cyclones and many others, virtually irrespective of shape or accessibility. Performing the method of the invention is quick and cost-effective, and is relatively less labor intensive than methods of known art. The present invention also allows for low-cost, continuous or repeated cleaning of vessels on a regular basis or as is required. This aspect is especially relevant to materials or containers in which even a minimal accretion is undesirable. Additionally, the apparatus and method of the present invention reduces the risk of damage to a vessel being treated. Furthermore, the apparatus and method of the present invention eliminates the production of environmentally unfriendly by-products or effluents and substantially reduces the production of dust in the cleaning process. Since no flammable substances are employed, the present invention also reduces risk of explosion within a container being treated.

BRIEF DESCRIPTION OF THE DRAWINGS

The present invention will be more fully understood and its features and advantages will become apparent to those skilled in the art by reference to the ensuing description, taken in conjunction with the accompanying drawings, in which.

DETAILED DESCRIPTION OF PREFERRED EMBODIMENTS OF THE INVENTION

The apparatus and method described below relate to the use of gas impulse devices for loosening accumulated solid particles and, in so doing, for cleaning the interior and, where applicable, the exterior of vessels, surfaces and other solid handling equipment. This cleaning process is achieved by supportively positioning one or more gas impulse devices in close proximity to accumulated solids on the surface in question and by supplying compressed gas to the device for repeatedly generating gas-borne shock waves. Repeated shock waves impinging on the accumulated solid particles and on the adjacent surface have the effect of shaking, vibrating and, hence, loosening the solids as a result of resonance occurring on the solids and on the surface. The gas impulse devices are moved about, against, or near to the surface having the accumulated solids, to facilitate cleaning. An alternative to moving the device adjacent to the surface to be cleaned is to fixably mount gas impulse devices in appropriate positions, where solids tend to accumulate. These fixed devices are operated either periodically when the accumulation becomes unacceptable or on an ongoing or scheduled basis to prevent any build-up of solids.

Examples of applications of embodiments of the present invention relate to one or more gas impulse devices applied to a variety of external surfaces including, to mention a few, particulate-solid conveyors, walls, floors, roadways, dumpster-trucks and other vehicles, especially those utilized in the handling of particulate solids.

Figure 1A:
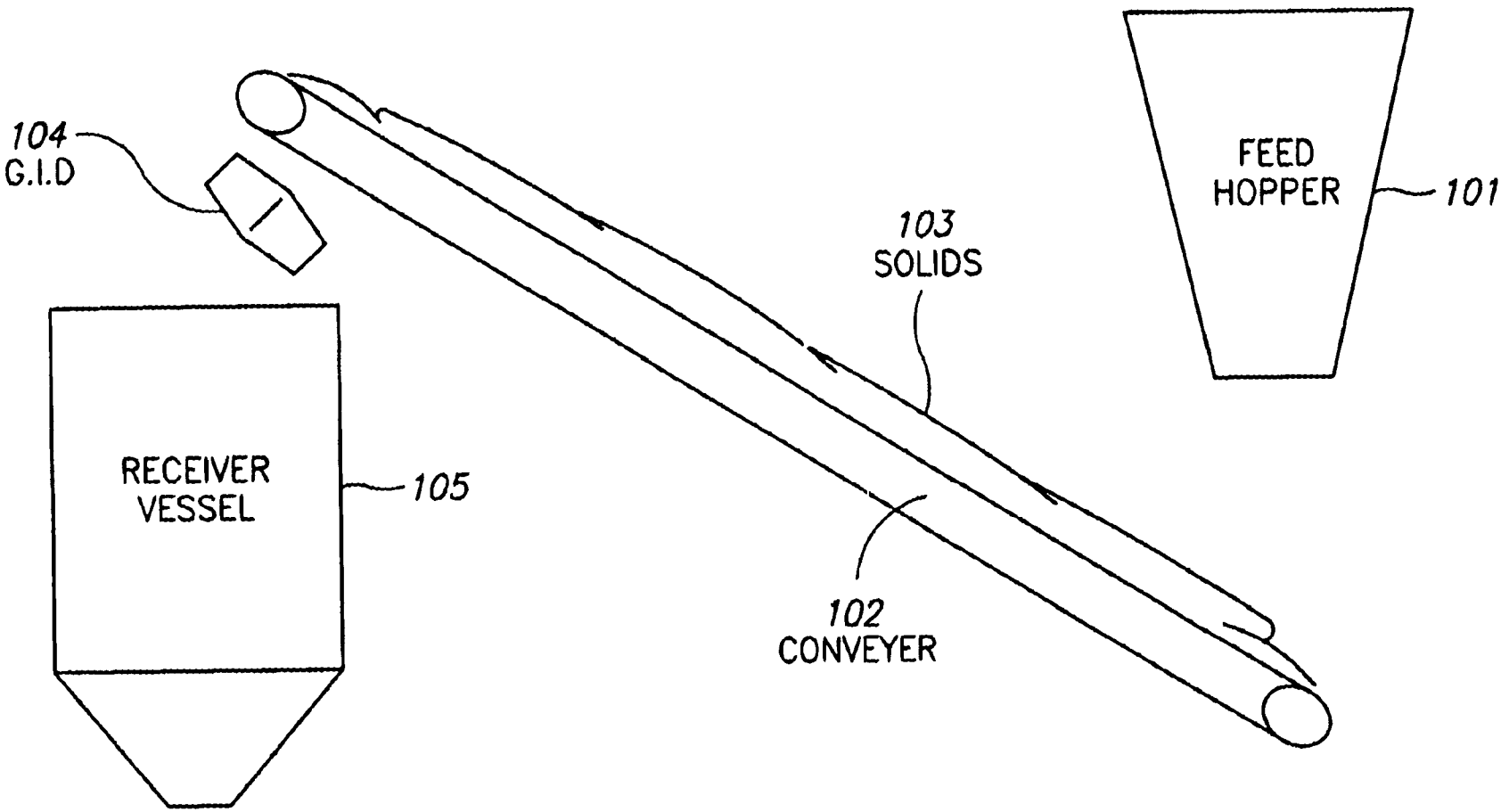
FIG. 1A is a schematic representation of a conveyer system demonstrating the cleaning of the under surface of a conveyer belt using a shock wave generating apparatus.

With reference to FIG. 1A, there is seen a conveyor system for removing particulate solid material 103 from a feed hopper 101 using a belt-type conveyer 102 and a receiver vessel 105. In order to remove any solid material adhering to or collecting on the external conveyer surface, one or more gas impulse devices 104 are mounted so as to allow shock waves to impinge on the agglomerated material on the returning belt and thereby to loosen this solid material.

Figure 1B:
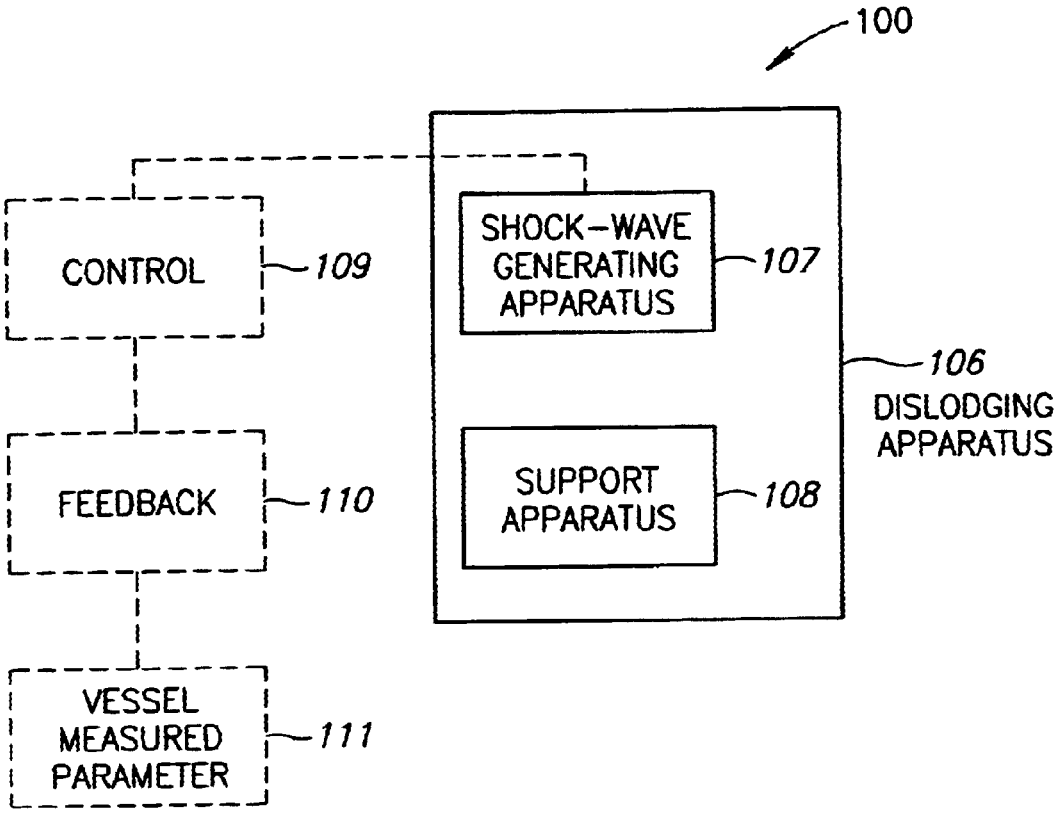
FIG. 1B is a block diagram representation of apparatus for generating gas-borne shock waves in the interior of a vessel, constructed in accordance with a preferred embodiment of the invention and includes a control for the apparatus.

With reference to FIG. 1B, there is seen dislodging apparatus denoted 106, which includes a shock generating apparatus 107 and a support apparatus 108. The shock generating apparatus 107, includes, in accordance with embodiments of the present invention, gas impulse devices which repeatedly generate frequent gas-borne shock waves in the interior or against the exterior of a vessel. The support apparatus 108 may include any sort of suspending devices, such as cables, chains, rods, cranes and the like as well as fastening devices, such as nuts and bolts, clamps, and so on. There is further seen an optional control mechanism 109, such as a valve, operating in accordance with feedback data 110 received from measured parameters 111 in or adjacent to the vessel.

According to embodiments of the present invention, which relate to an apparatus and a method for cleaning vessels used for the storage or handling of particulate solid materials, in many instances, particulate solids tend to agglomerate or accumulate against the walls of vessels or of other material handling equipment. Furthermore, according to embodiments of the present invention, one or more shock wave generating devices such as gas impulse devices are used for applying individual or repeated gas-borne shock-waves to accretions of solids on the vessel walls, as described in the Applicant's co-pending U.S. application Ser. No. 09/259,363 for generating shock-waves or gas impulses. Shock waves are generated with impulses of between approximately 0.3 and 5 times per second, the shock wave frequency in the range of 100–1000 Hz and having a wavelength in the range of 1–5 msecs, using compressed gas at a pressure in the range of 1 to 350 bar but generally in the range of 50 to 200 bar.

Vessels for storing or holding substantially dry, particulate materials include silos, hoppers, bins, tanks and others are potentially subject to accretion of agglomerated solid material, as a consequence of the particles being inherently cohesive, being compatible or being moist. Furthermore, other solid material handling equipment, such as dust separating cyclones, dust filters, electrostatic separators, ducting, chimneys, piping, and even tipper-trucks, to mention a few, are also subject to such an accretion problem. In addition, in terms of embodiments of the present invention, accretion of particulate solids to surfaces other than vessel interiors is also removable using shock wave generating devices such as a gas impulse device.

Figure 2:
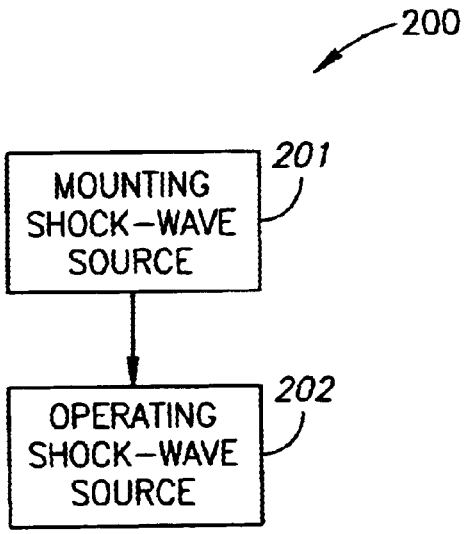
FIG. 2 is flow chart representation of a method for dislodging an accretion of a substance deposited on a wall of a vessel.

Referring now to FIG. 2 the method 200 of the invention is seen to include the steps of mounting 201 the shock wave source in the proximity of accrued particulate solids using suitable mounting or fastening devices as mention above, and operating 202 the shock wave source by initiating the supply of an appropriate high pressure gas. Furthermore, where the gas impulse device is suspended or supported proximate to the surface to be cleaned, the device is moved in the vicinity of the region having accrued solids to achieve removal of the solids.

Figure 3:
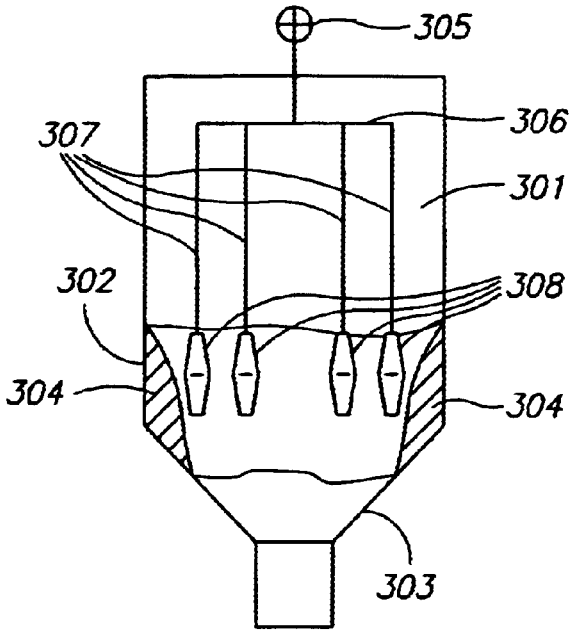
FIG. 3 illustrates a schematic cross-sectional view of a silo having an accretion of a substance deposited against an interior wall thereof.

Referring now to FIG. 3, there is depicted a schematic, cross-sectional view of a vessel 301 having an accretion of a substance referenced generally 304, deposited against a junction formed between a cylindrical portion 302 of the vessel wall and a lower conical section 303 thereof. Such accretions often occur in regions of a vessel characterized by reduced material movement such as corners, irregularities in the surface wall, contour changes to the vessel surface, and joins in the vessel such as the junction between a vertical wall and an inverted pyramidal or conical base. Additionally depicted in this figure are multiple gas impulse devices 308, suspended from a supporting mechanism 305, supporting frame 306 and suspending cables 307 such that the gas impulse devices are positioned proximate to the accretion of solid material on the interior walls. Such an arrangement is generally but not limited to large vessels which, for example, are filled and then emptied of their contents and require substantial clearing of any accumulated material prior to being refilled.

Figure 4:
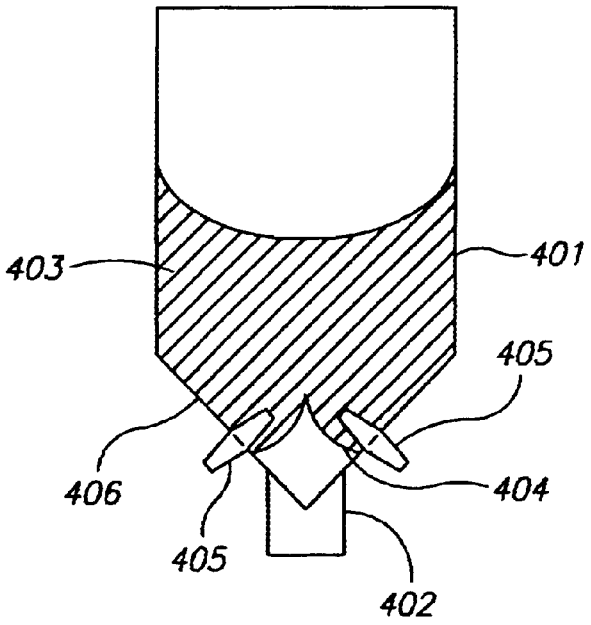
FIG. 4 illustrates a schematic cross-sectional view of a silo wherein particulate solids form a "bridging" over the vessel outlet.

Referring now to FIG. 4, there is illustrated a schematic, cross-sectional view of a vessel 401 whose contents, referenced generally 403, form a "bridging" 404 over the vessel outlet 402 in the vicinity of a lower, tapered section of the conical wall 406 of the vessel 401. This is a consequence of agglomeration, that is, the accumulation of compacted, cohesive particulate material. Many particulate materials do not flow freely especially in the presence of any moisture, or if the material has a high angle of repose due to physical characteristics of the solid material, or if the material is naturally compactable. Further, there are materials which tend to absorb moisture from the atmosphere, from the air, or from another gas that is used in some systems to promote the flow of the solids. Drier materials are generally more free-flowing, and, therefore do not build up or agglomerate as severely as moist materials. In addition, material which does not tend to agglomerate requires less power to loosen when such build-ups do occur. In order to breakdown the bridging agglomerate, for example, but not limited to this technique, one or more gas impulse devices 405 are installed through the conical wall 406 of the vessel 401 near to the outlet 402. The gas impulse devices are operated to prevent bridging, either on a continuous basis or on a programmed cyclic basis, or, alternatively, are operated specifically when bridging occurs.

Figure 5:
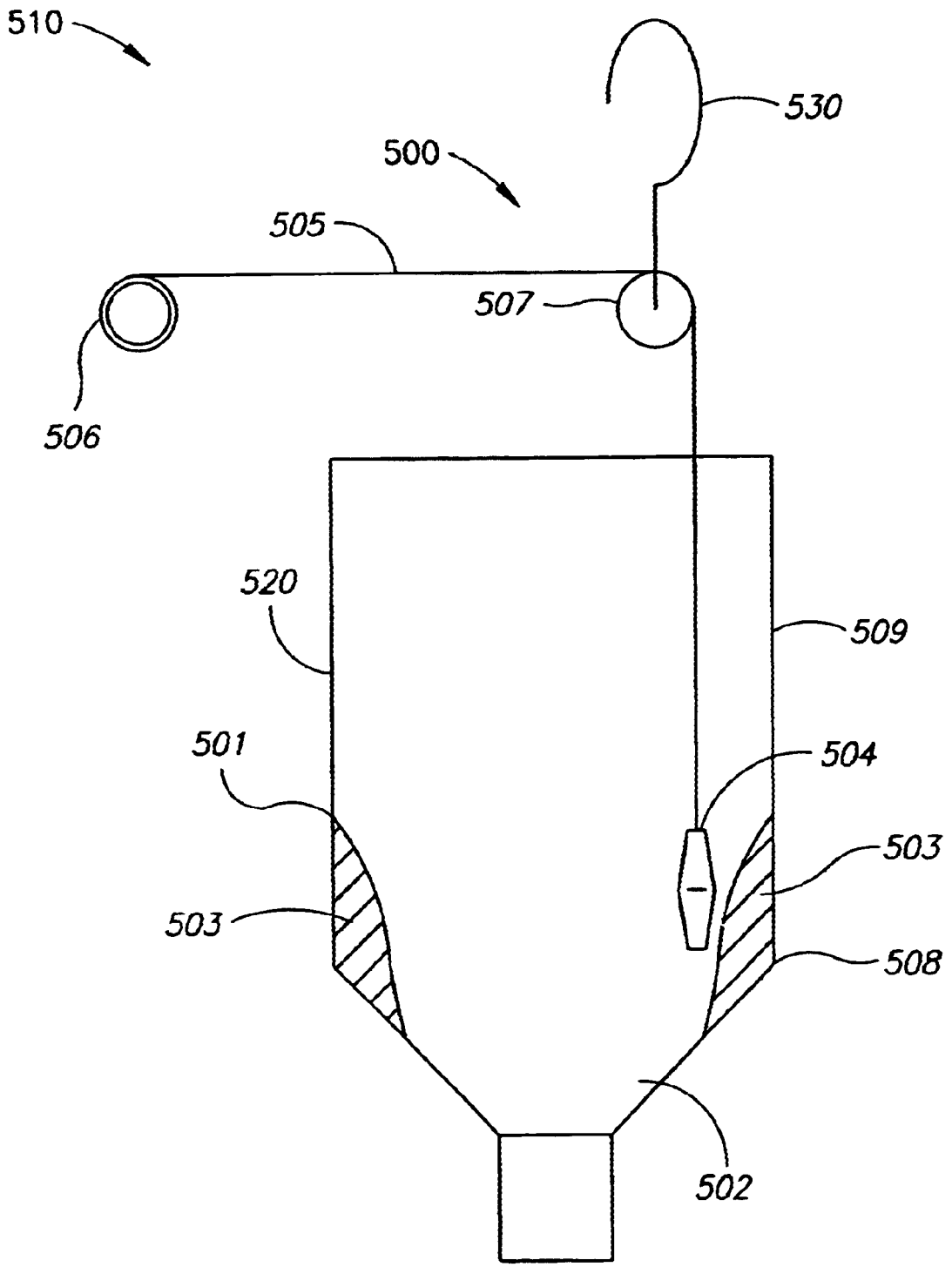
FIG. 5 illustrates a schematic cross-sectional view of a silo similar to that of FIG. 3, having an accretion of a substance deposited against the interior vessel walls thereof, and wherein shock wave generating apparatus, constructed in accordance with a preferred embodiment of the invention, is suspended within the vessel adjacent to the accrued deposits.

Referring generally now to FIG. 5, there is illustrated a schematic cross-sectional view of a silo 501, which is similar to silo 302 of FIG. 3 and has an accretion of substances 503 deposited against the interior vessel walls 520. In the present drawing, the accretion of solids is depicted in the vicinity of a junction 508 formed between a cylindrical wall portion 509 and a lower conical section 502 of the vessel.

FIG. 5 also illustrates apparatus, referenced generally 510, constructed and arranged in accordance with a preferred embodiment of the invention, for dislodging an accretion of a substance from a wall of a vessel. Apparatus 510 includes one or more shock wave generating devices 504, which are typically adjustably suspended by means of a cable or chain 505 within the vessel 501 adjacent to the accrued deposits 503, using a suitable suspending mechanism 500.

In accordance with a preferred embodiment of the invention, devices 504 are any suitable gas impulse or shock wave generating device such as the Gas Impulse Device as disclosed in Applicant's co-pending U.S. application Ser. No. 09/259,363, the contents of which are incorporated herein by reference.

Other suitable gas-blasting devices may also be used, such as the Bolt Air Guns marketed by the Bolt Technology Corporation, which device is disclosed, inter alia, in U.S. Pat. Nos. 4,779,245 and 4,754,443. Therein is described an example of air blasting apparatus for performing cleaning in liquid environments, such as sewage pipes and oil wells. These patents describe an air-blasting cartridge comprising a housing subdivided into an inlet chamber and a discharge chamber by virtue of a piston arranged lengthwise along a longitudinal axis of the housing. The inlet chamber communicates with a source of compressed air through an air admission tube, which runs the length of the cartridge through an axial port of the piston. The discharge chamber communicates with the inlet chamber through an annular gap between the air admission tube and the piston. The discharge chamber is adapted to communicate with the surrounding atmosphere at the instant of its discharge, by means of at least one open-ended passage made in the housing close to the inlet chamber, wherein a pressure relief valve is provided at the outlet end of the passage.

Considering now suspension mechanism 500 in more detail, this consists of an extendable chain or cable 505, which is advanced or retracted via a rotating drum 506 or other feeding device typically located outside of and adjacent to the vessel. Gas impulse device 504 is advanced or retracted by rotating drum 506 and each chain 505 is supported by a pulley 507, a hook or other supporting mechanism 530, typically mounted in the roof of the vessel or external to the vessel, to facilitate advancing or retracting of the chain of the device 504 within the vessel. The chain is used to suspend each gas impulse device or group of gas impulse devices so that the position of each gas impulse device is vertically adjusted to maintain close proximity or contact between the gas impulse device and the accretion deposited within the vessel. The gas impulse device is, in addition, so suspended into the vessel, that the device can be moved circumferentially about the inner wall face to remove accretion of solids.

Figure 6A:
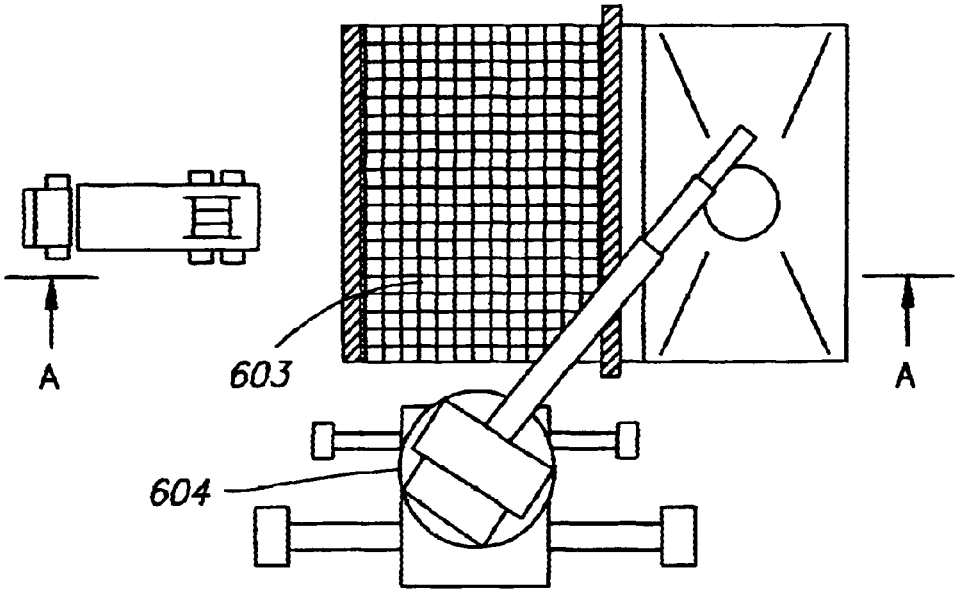
FIGS. 6*a* and 6*b* respectively illustrate schematic plan and cross-sectional views of apparatus constructed in accordance with a preferred embodiment of the invention, arranged for cleaning accrued substances from a feed chute blocked as a consequence of rat-holing.
Figure 6B:
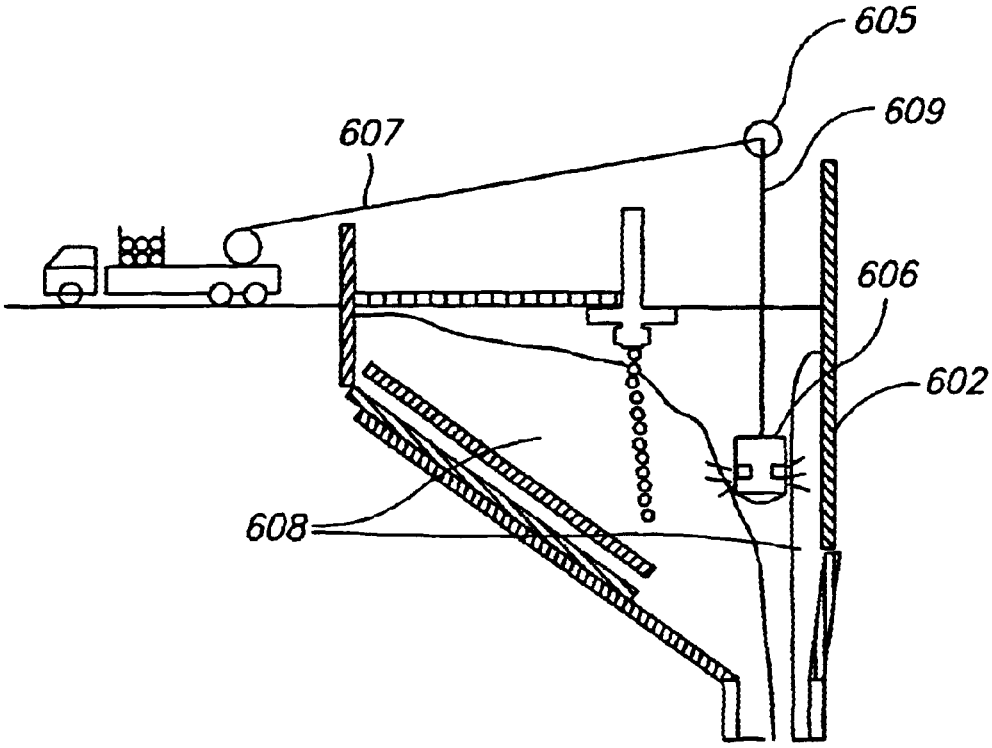

Another example of an application of the preferred embodiment relates to FIGS. 6A and 6B, which illustrate, respectively, a schematic plan and cross-sectional view of a feed hopper 602 through which particulate solids are fed, via a screen mesh 603, into a holder such as a silo or a bin (not shown). In much the same manner as described above, using a suspending device such as a crane 604 and hook 605, a gas impulse device 606 is lowered at the end of a chain or cable 609 into the partially or totally blocked hopper 602. After being positioned adjacent to the accumulated mass of agglomerated material 608, high-pressure gas is admitted to the gas impulse device thereby to break up and loosen the agglomerated material. As the material is loosened and broken up, the gas impulse device is raised or lowered and moved laterally about the hopper, to complete the cleaning process.

Figure 7:
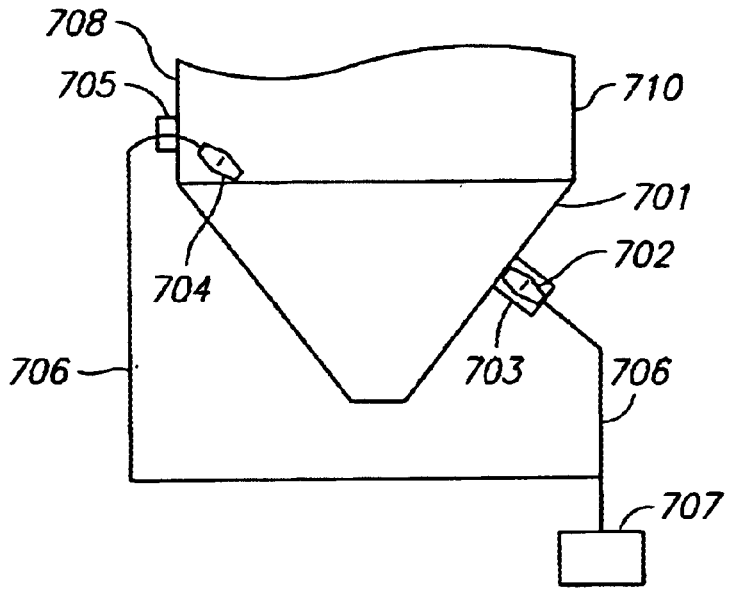
FIG. 7 illustrates a schematic cross-sectional view of a silo, having shock-wave-generating devices mounted within the walls thereof.

Referring to FIG. 7, this illustrates a schematic view of the lower conical or pyramidal portion 701 of a vessel 710. According to the preferred method of the present invention, a gas impulse device 702 is fixably mounted by a fastening mechanism 703 into, for example, the lower, conical wall of vessel 710 such that the shock waves are deflected into the agglomerated material in the vessel. Alternatively, a gas impulse device 704 may be inserted into an orifice 705 in a vertical wall 708 if vessel 710, such that the device lies within the agglomerated material within the vessel. It is anticipated that particulate solids accumulate as an agglomerated mass, for example, as bridging over the vessel outlet or as rat-holing within the vessel. Such fixable mountings of the gas impulse devices are so arranged such that gas impulse devices are either left permanently in position or, alternatively, are moved from vessel to vessel as required.

Compressed gas is supplied to each gas impulse device through a high-pressure conduit 706 from a high-pressure gas source 707 at pressures ranging from 1 to 350 bars. In the aforementioned embodiment relating to adjustable, movable gas impulse devices, this conduit may be a flexible high-pressure hose. Where the gas impulse devices are permanently mounted in the wall of a vessel, fixed piping is generally preferred.

Figure 8:
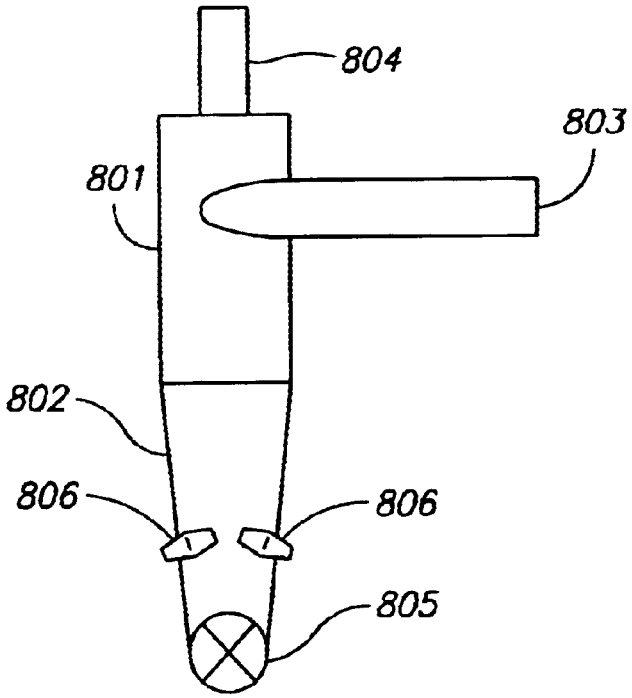
FIG. 8 illustrates a schematic view of a dust-removing cyclone, having shock-wave-generating devices mounted within the walls of the lower conical section thereof.

A further example of an application of the present invention relates to one or more gas impulse devices fixably mounted into the walls of a vessel, for example a cyclone dust extractor. Referring now to FIG. 8, illustrated therein is a dust removal cyclone separator 801. Dust bearing gas is admitted through the inlet 803 into the cyclone and substantially dust free gas leaves the cyclone through the outlet 804. Dust collects in the lower conical section 802 and is discharged through the outlet valve 805. To avoid accumulation of dust in the cyclone conical section, one or more gas impulse generators 806 are fixably mounted through the conical wall or into any other suitably positioned opening in the vessel wall. Due to the relative inaccessibility of such cyclones, permanently mounting one or more gas impulse devices enables the cleaning of agglomerated dust from the cyclone walls without the need to dismount or dismantle the cyclone. Such a utilization has the advantage of being applicable as part of the regular operation of the vessel and is similarly applicable to other material handling equipment such as chimney-stacks, ducting, filters and so on. Moreover, such fixably mounted gas impulse units are also permanently installed in any of the items of solid handling equipment mentioned heretofore, for the purposes of flow stimulation and prevention of accumulation, bridges or blockages of particulate solids. Furthermore, the cleaning of cyclones and other vessels can be accomplished by lowering a gas impulse device into the vessel instead of fixably mounting the devices into the vessel walls.

Figure 9:
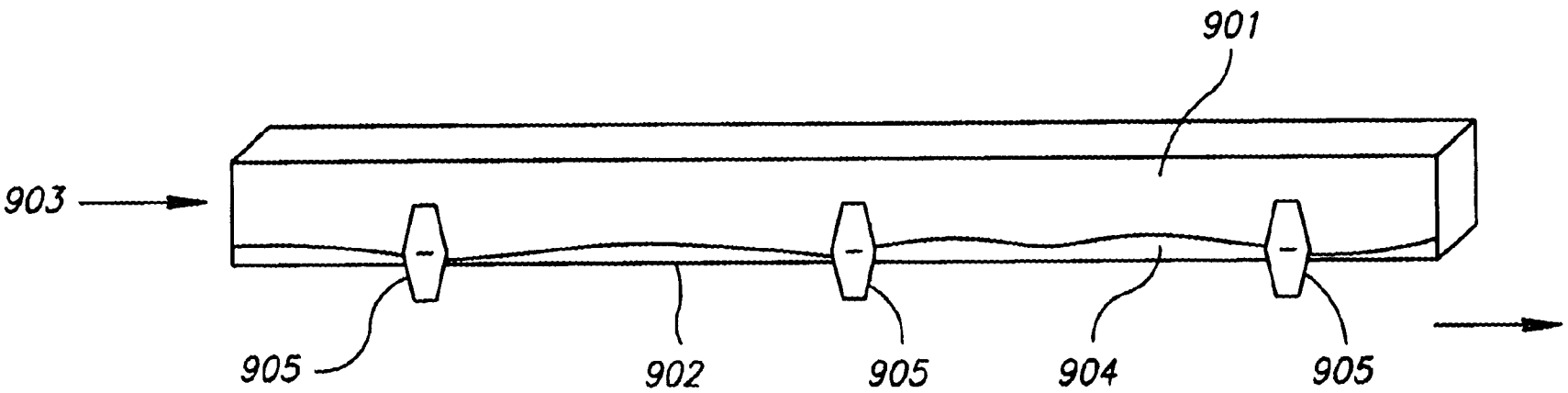
FIG. 9 illustrates a schematic cross-sectional view of a horizontal duct carrying dust-laden air and incorporating gas impulse generating devices to dislodge deposited dust.

The present invention is not restricted to cleaning vertical or upright surfaces but is also applicable to substantially horizontal surfaces. Referring now to FIG. 9, illustrated therein is a cross sectional view of a horizontal duct 901 carrying dust-laden air 903. Dust 904 settles along the lower inner surface 902. In order to dislodge this dust, gas impulse devices 905 can be, for example, fixably mounted into the lower surface and operated periodically to loosen the dust layer. Alternatively, gas impulse devices are pulled or pushed over or through, for example, horizontal piping or ducting using cables, chains, rods and the like. Furthermore, the presence of suitably inclined discharge ports in the gas impulse device enables the device to advance, propelled with each pulse. In such substantially horizontal applications, there is a difference in the technique of usage. Insofar as gravity assists in the removal of loosened material from vertical surfaces, in the case of horizontal surfaces, loosened material not removable by regular processing must be physically removed manually, by vacuum, by flushing, by washing away with a suitable liquid medium or the like.

Applying high-pressure gas to each gas impulse device, at a pressure in the range 1–350 bar, in accordance with and appropriate to the severity of the accumulation and the agglomeration, produces a series of shock waves to the adjacent accumulated agglomerated material, causing the agglomerate and the vessel wall to resonate. This produces two effects. Primarily, shaking and shock wave impacting of the material adjacent to the gas impulse device occurs, causing the agglomerated material to progressively break down, crumble or even fluidize and to be removed by the gas blast from the vessel wall or from bridging or rat-holing the vessel outlet. Secondly, significant vibrations are caused to the entire vessel, contributing to a more general loosening of agglomerated material. For example, the time for cleaning of silos containing up to several hundred tons of solids can be reduced from hours or even days to minutes.

The decision regarding a suitable gas to be utilized in each application depends on the possibility of chemical interaction between the particulate solid material and the gas. Where there is no such risk of interaction, air is preferred for reasons of cost and availability. However, in the presence of oxygen in the air, many finely divided particulate materials present a risk of dust explosions or flammability. Alternative gases for use in such instances include nitrogen or carbon dioxide, although the latter presents a somewhat lower pressure capability. In extreme cases, it is necessary, prior to commencing the cleaning operation, to purge the vessel with nitrogen or carbon dioxide to remove the oxygen, to reduce any explosion or flammability risk.

It will be appreciated by persons skilled in the art that the present invention is not limited by the drawings and description hereinabove presented. Rather, the invention is defined solely by the claims that follow.

What is claimed is:

1. Apparatus for dislodging an accretion of a substance from a wall of a vessel arranged to contain gas, said apparatus including:

a) apparatus for generating gas-borne shock waves in a non-liquid environment in the vicinity of a vessel arranged to contain gas, thereby to expose a substance accrued on a surface thereof to separation forces causing at least partial separation of the substance from the surface, so as to facilitate removal of the at least partially separated substance therefrom; and b) support apparatus for supporting said apparatus for generating shock waves in a selected orientation relative to the vessel.

2. Apparatus according to claim 1 wherein apparatus for generating gas-borne shock waves includes at least one gas impulse device whereby compressed gas is utilized to generate gas-borne shock waves.

3. Apparatus according to claim 2 wherein said at least one gas impulse device is operable for adjustable positioning within the vessel, and operable for positioning adjacent to the substance accrued on an inward-facing surface of the vessel.

4. Apparatus according to claim 2 further including a compressed gas source fixably connected via a conduit to said at least one gas impulse device whereby a compressed gas is supplied to said at least one gas impulse device.

5. Apparatus according to claim 4 wherein said compressed gas includes at least one gas selected from the group consisting of:

i) air;

ii) nitrogen;

iii) carbon dioxide; and iv) mixtures of at least two of the aforementioned gases.

6. A method of dislodging an accretion of a substance deposited in the vicinity of a vessel arranged to contain gas, the method including the steps:

i) mounting a source of gas-borne shock waves in a selected orientation with respect to a substance accrued on a surface of a vessel;

ii) operating the source of gas-borne shock waves so as to expose the accrued substance to separation forces, thereby causing at least partial separation of the accrued substance from the surface, so as to facilitate removal of the at least partially separated substance from the vessel.

7. The method according to claim 6 wherein said step of mounting includes fixably attaching the source of gas-borne shock waves within an inward-facing surface of the vessel.

8. The method according to claim 6 wherein said step of operating includes supplying a compressed gas to the source of the gas-borne shock waves.

9. A method of dislodging an accretion of a substance deposited in the vicinity of a vessel, the method including the steps:

i) mounting a source of gas-borne shock waves in a selected orientation with respect to a substance accrued on a surface of a vessel;

ii) operating the source of gas-borne shock waves so as to expose the accrued substance to separation forces, thereby causing at least partial separation of the accrued substance from the surface, so as to facilitate removal of the at least partially separated substance from the vessel, wherein said step of mounting includes adjustably suspending said source of gas-borne shock waves within the vessel.

10. A method of dislodging an accretion of a substance deposited in the vicinity of a vessel, the method including the steps:

i) mounting a source of gas-borne shock waves in a selected orientation with respect to a substance accrued on a surface of a vessel;

ii) operating the source of gas-borne shock waves so as to expose the accrued substance to separation forces, thereby causing at least partial separation of the accrued substance from the surface, so as to facilitate removal of the at least partially separated substance from the vessel, wherein said step of operating includes moving said source of said gas-borne shock waves within the vessel thereby to expose the substance accrued on an inward-facing surface thereof to separation forces causing at least partial separation of the substance from the inward-facing surface, so as to facilitate removal of the at least partially separated substance therefrom.

* * * * *